US008003908B2

(12) United States Patent
Zuo

(10) Patent No.: US 8,003,908 B2
(45) Date of Patent: Aug. 23, 2011

(54) SLIDE-TYPE BUTTON ASSEMBLY

(75) Inventor: Zhou-Quan Zuo, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 109 days.

(21) Appl. No.: 12/606,552

(22) Filed: Oct. 27, 2009

(65) Prior Publication Data

US 2010/0108483 A1 May 6, 2010

(30) Foreign Application Priority Data

Oct. 31, 2008 (CN) ..... 2008 1 0305337

(51) Int. Cl.
*H01H 9/02* (2006.01)

(52) U.S. Cl. ..... 200/332.1

(58) Field of Classification Search ..... 200/332.1, 200/5 R, 16 R, 18, 330, 50.35, 547
See application file for complete search history.

(56) References Cited

U.S. PATENT DOCUMENTS 3,154,659 A * 10/1964 Flanagan, Jr. et al. ..... 200/547
4,115,670 A * 9/1978 Chandler ..... 200/5 R
6,841,744 B1 * 1/2005 Kodo et al. ..... 200/16 C
7,208,692 B2 * 4/2007 Yamaguchi ..... 200/547

* cited by examiner

*Primary Examiner* — Edwin A. Leon
(74) *Attorney, Agent, or Firm* — Altis Law Group, Inc.

(57) ABSTRACT

A slide-type button assembly includes a body member, a sliding member slidably mounted in the body member, and an elastic member. The body member includes a sidewall, the sidewall defining an opening. The sliding member is slidably mounted in the body member, and partially exposing out of the opening. The elastic member is disposed between the body member and the sliding member, providing a force against the sliding member and press the sliding member against the interior surface of the sidewall.

19 Claims, 5 Drawing Sheets

SLIDE-TYPE BUTTON ASSEMBLY

BACKGROUND

1. Technical Field

The present disclosure relates to slide-type button assemblies and, particularly, to a slide-type button assembly used in a portable electronic device.

2. Description of Related Art

Slide-type button assemblies have been widely used in portable electronic devices such as mobile phones and personal digital assistants (PDAs).

A typical slide-type button assembly includes a sliding member slidably mounted in a cavity defined in a housing of a portable electronic device. The sliding member can slide between at least two positions. Different positions correspond to different functions. Thus a user can select different functions by sliding the sliding member.

However, contaminants, e.g., water and dust, may enter into space between the sliding member and the cavity, thus the portable electronic device.

Therefore, there is room for improvement within the art.

BRIEF DESCRIPTION OF THE DRAWINGS

Many aspects of the slide-type button assembly can be better understood with reference to the following drawings. These drawings are not necessarily drawn to scale, the emphasis instead being placed upon clearly illustrating the principles of the present slide-type button assembly. Moreover, in the drawings like reference numerals designate corresponding sections throughout the several views.

DETAILED DESCRIPTION

The present slide-type button assembly is suitable for use in a portable electronic device, e.g., mobile phone and personal digital assistant (PDA).

Figure 1:
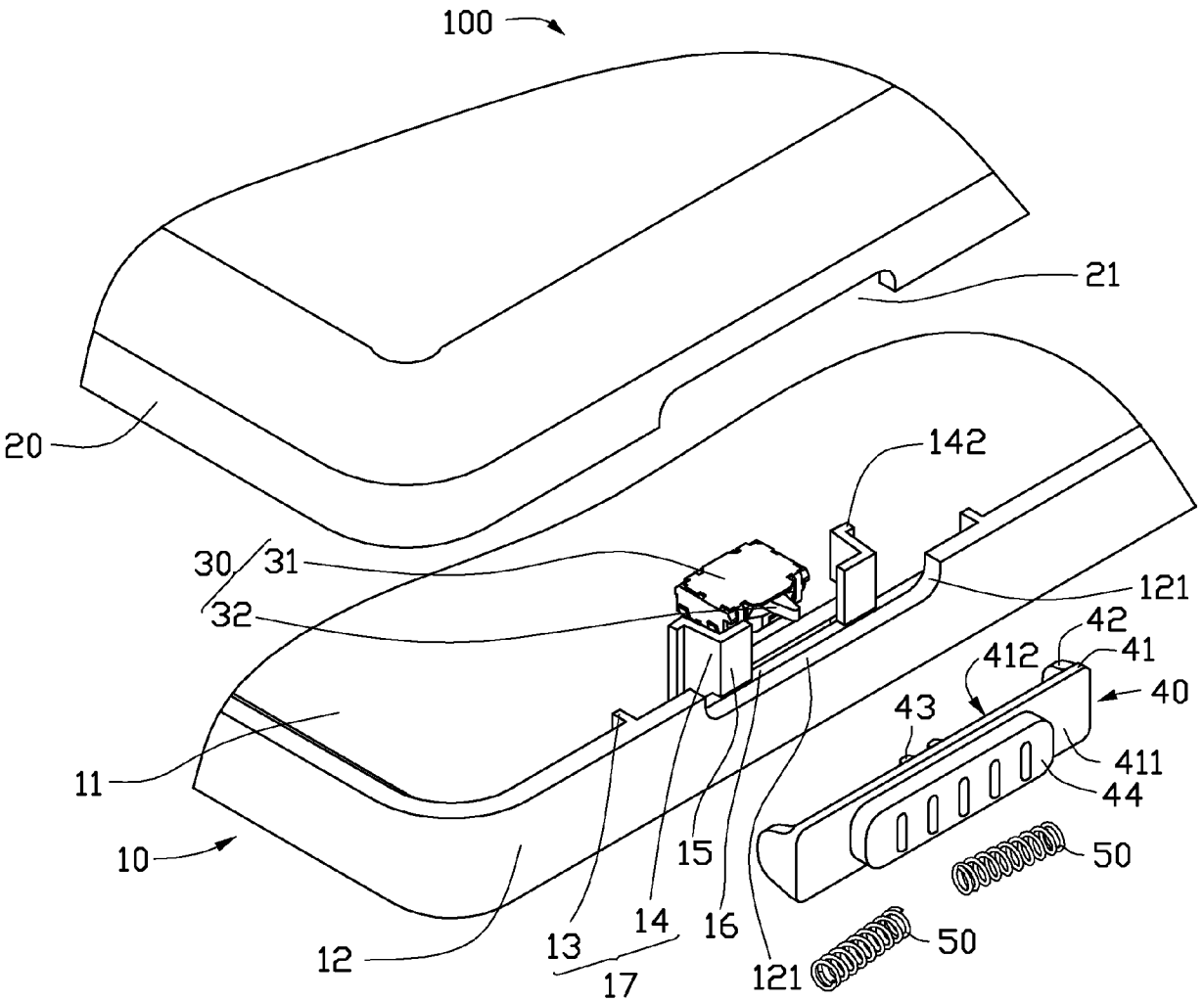
FIG. 1 is an exploded, isometric view of a slide-type button assembly, in accordance with an exemplary embodiment.
Figure 2:
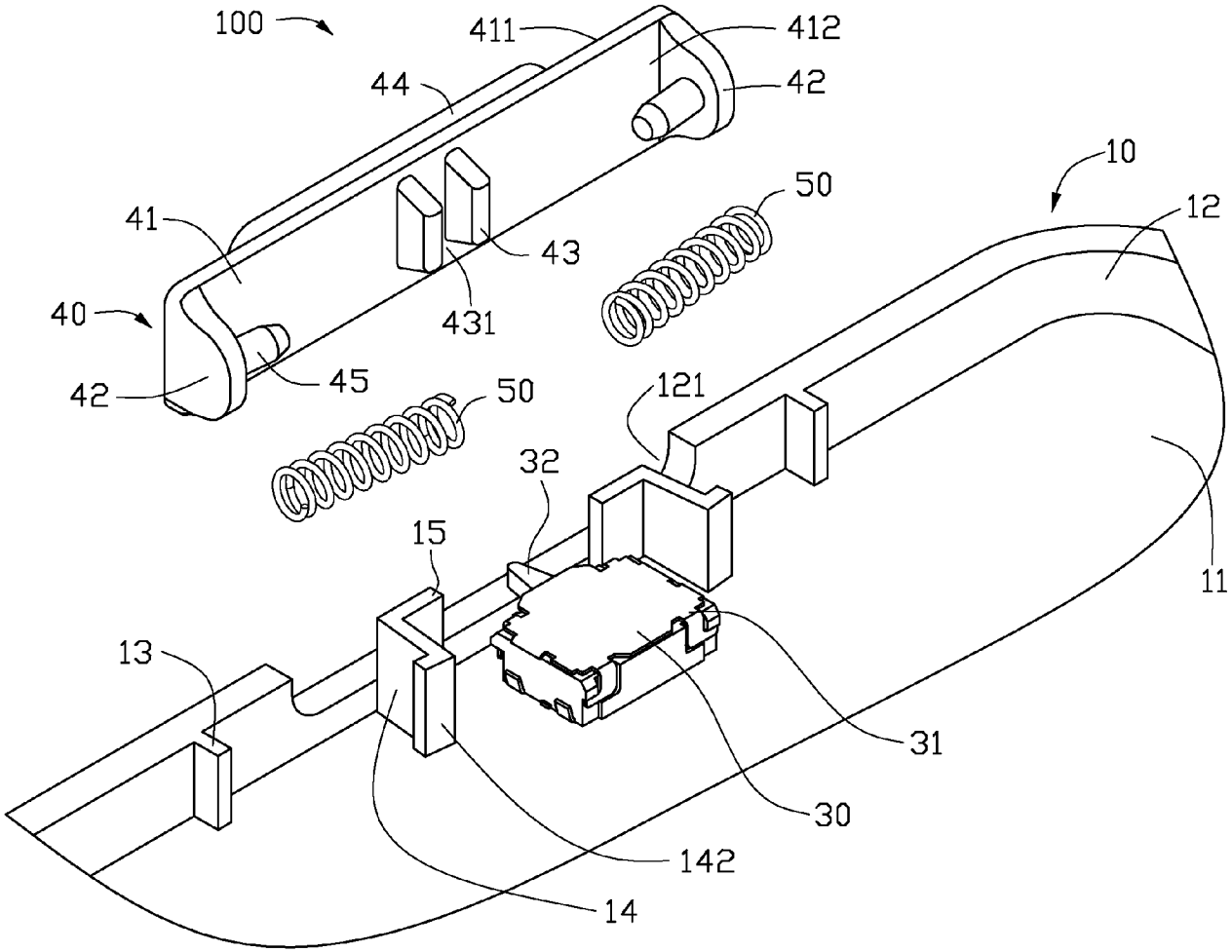
FIG. 2 is similar to FIG. 1, but viewed from another aspect.

Referring to FIGS. 1 and 2, an exemplary slide-type button assembly 100 includes a body member 10, a cover member 20, a switch 30, a sliding member 40, and two elastic members 50. The switch 30 is mounted in the body member 10. The sliding member 40 is sandwiched between the body member 10 and the cover member 20 and used to trigger the switch 30. The elastic members 50 are mounted between the body member 10 and the sliding member 40, providing force to drive the sliding member 40 to slide. The cover member 20 is attached to the body member 10 for receiving the switch 30, the sliding member 40 and the elastic members 50.

Figure 4:
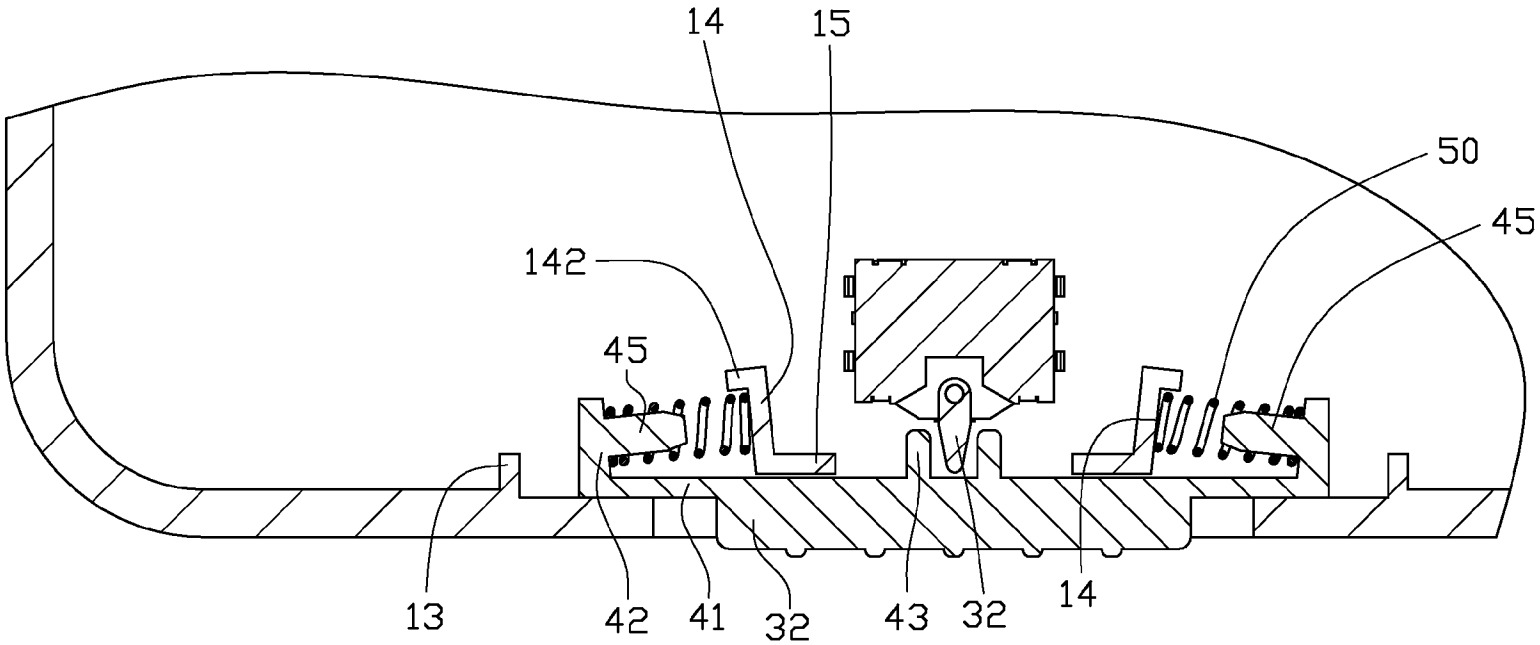
FIG. 4 is a cross-sectional view of the slide-type button assembly, taken along line IV-IV.
Figure 5:
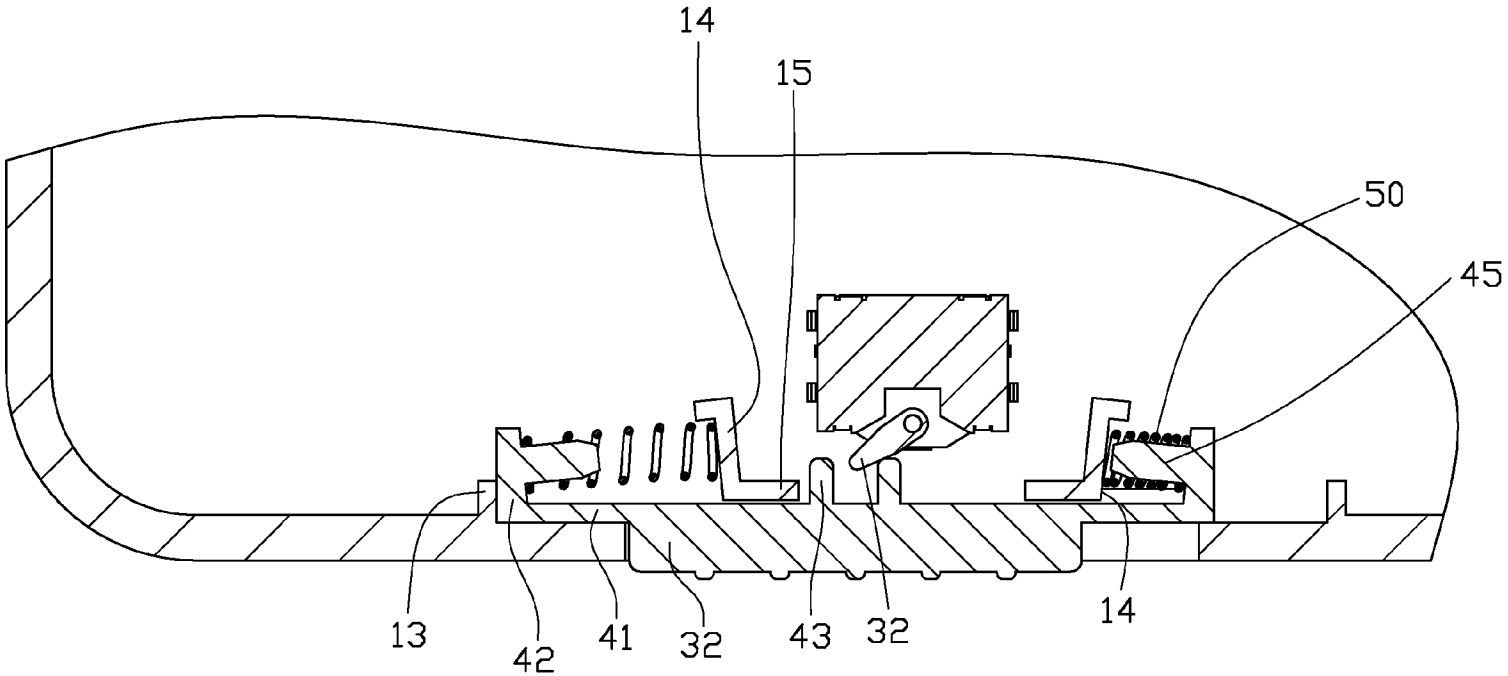
FIG. 5 is a schematic view showing the use of the slide-type button assembly.

The body member 10 includes a bottom wall 11 and a sidewall 12 perpendicular with the bottom wall 11. The sidewall 12 defines an opening 121. The switch 30 is fastened to the bottom wall 11, facing the opening 121. The body member 10 further includes an assembled portion 17. The assembled portion 17 includes two stopping blocks 13 and two resisting blocks 14. The two stopping blocks 13 perpendicularly and symmetrically protrude from an interior side of the sidewall 12, adjacent to the opening 121. The two stopping blocks 13 are for abutting against the sliding member 40. The two resisting blocks 14 protrude from the bottom wall 11 adjacent to the opening 121. One end of each resisting block 14 forms an extending end 142 facing a corresponding stopping block 13 and slightly angled towards the sidewall 12, thus a cross section of each resisting block 14 is a tilted L-shape. The elastic members 50 are respectively disposed between the sliding members 40 and the resisting blocks 14. The elastic members 50 can compress the sliding member 40 to tightly abut against an inner side of the sidewall 12, thus efficiently avoid any space exposed between the sliding member 40 and the sidewall 12 (FIG. 4). The other end of each resisting block 14 forms a limiting portion 15 facing the opening 121. Each limiting portion 15 is generally plate-shaped parallel with the sidewall 12, and is spaced apart from each other, thus defining a slot 16 therebetween. The sliding member 40 is slidably received in the slot 16. In this embodiment, each resisting block 14 connects to a corresponding limiting block 15.

The cover member 20 includes a cutout 21 defined therethrough and corresponding to the opening 121. The cutout 21 and the opening 121 cooperatively surround a channel through which the sliding member 40 is inserted into the body member 10.

The switch 30 has a plurality of gear positions. In this embodiment, the switch 30 has two gear positions. Each gear position corresponds to one function of the portable electronic device. The switch 30 includes a main body 31 and a dialing post 32 swinging relative to the main body 31 driven by the sliding member 40.

The sliding member 40 includes a main portion 41, two resisting portions 42, two projections 43, an operating portion 44, and two posts 45. The main portion 41 includes a first surface 411 and a second surface 412 opposite to the first surface 411. The two resisting portions 42 perpendicularly protrude from both ends of the main portion 41. The two posts 45 respectively protrude from one resisting portion 42, slightly angled away from the main portion 41 (FIG. 4). The two elastic members 50 respectively coil around a corresponding post 45, with one end resisting the resisting portion 42, the other end resisting the resisting block 14. The two spaced projections 43 protrude a center of the second surface 412, thereby defining a slit 431 therebetween. The slit 431 receives the dialing post 32 therein. The operating portion 44 is integrally formed at the first surface 411 of the main portion 41, used to facilitate sliding the sliding member 40 in the slot 16.

Figure 3:
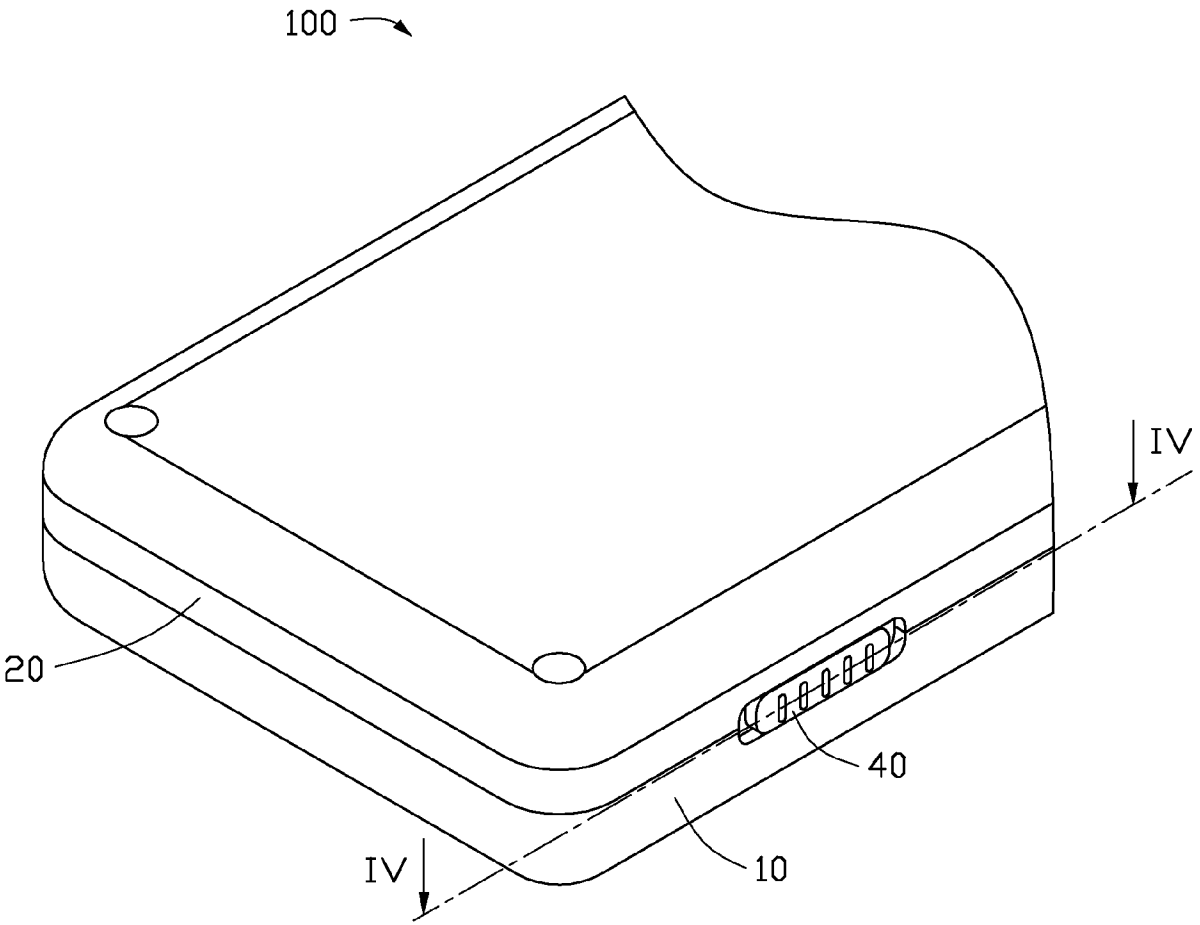
FIG. 3 is an assembled view of the slide-type button assembly shown in FIG. 1.

Referring to FIGS. 3 and 4, in assembly, each elastic member 50 is coiled around one post 45, with one end are for abutting against and fixed to a corresponding resisting portion 42 by typical means, e.g. hot-melting. The sliding member 40 is inserted into the slot 16, with the operating portion 44 exposing out of the opening 121, and the other end of each elastic member 50 are for abutting against and fixed to the resisting block 14 by typical means, e.g. hot-melting. At this time, the dialing post 32 is received in the latching slit 431, thus a user can operate the dialing post 32 via the sliding member 40.

In use, an external force is applied on the operating portion 44 until the sliding member 40 is slid towards one stopping block 13. One elastic member 50 is compressed, and the other elastic member 50 is stretched. The sliding member 40 is continued to be slid until one resisting portion 42 are for abutting against a corresponding stopping block 13. At this time, the dialing post 32 of the switch 30 has been turned to a gear position. It is to be understood, if the sliding member 40 is slid to another direction, the dialing post 32 of the switch 30 can be turned to another gear position.

The slide-type button assembly 100 can effectively protect water or dust from entering into the body member 10, using the sliding member 40 compressed by the two elastic members 50.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of sections within the principles of the disclosure to the full extent indicated by the broad general meaning of the terms, in which the appended claims are expressed.

What is claimed is:

1. A slide-type button assembly comprising:

a body member including a sidewall and an assembled portion, the sidewall defining an opening, the assembled portion including at least one resisting block, the at least one resisting block slightly angled towards the sidewall;

a sliding member slidably mounted in the assembled portion of the body member, and one portion of the sliding member partially exposing out of the opening, and an elastic member disposed between the resisting block of the assembled portion and the sliding member providing a force against the sliding member and compress the sliding member against an interior surface of the sidewall.

2. The slide-type button assembly as claimed in claim 1, wherein at least one resisting block includes a limiting portion, the limiting portion and the sidewall defines a slot, the sliding member is slidably received in the slot.

3. The slide-type button assembly as claimed in claim 1, wherein the body member includes a bottom wall connected to the sidewall, the resisting block protrudes from the bottom wall adjacent to the opening.

4. The slide-type button assembly as claimed in claim 1, wherein the assembled portion further includes a stopping block, the stopping block perpendicularly protrudes from the interior surface of the sidewall, adjacent to the opening, the stopping block for abutting against the sliding member.

5. The slide-type button assembly as claimed in claim 1, further comprising a switch, wherein the switch is mounted to the body member, facing the opening, the sliding member slides to trigger the switch.

6. The slide-type button assembly as claimed in claim 5, wherein the switch is a double-gear switch corresponding to two functions, the switch includes a main body fastened to the body member, and a dialing post swinging relative to the main body and driven by the sliding member.

7. The slide-type button assembly as claimed in claim 6, wherein the sliding member includes a main portion and two spaced-apart projections, the two projections formed on the main portion and defining a latching slit therebetween, the slit receiving the dialing post therein.

8. The slide-type button assembly as claimed in claim 1, wherein the sliding member includes a main portion, and an operating portion, the operating portion forms a surface used to facilitate sliding the sliding member.

9. The slide-type button assembly as claimed in claim 1, wherein the sliding member includes a main portion, one resisting portion, and one post, the resisting portion perpendicularly protrudes from one end of the main portion, the post protrudes from the resisting portion, slightly angled away from the opening, the elastic member coils around the post, with one end resisting the resisting portion, the other end resisting the resisting block.

10. A slide-type button assembly comprising:

a body member including a sidewall and an assembled portion, the sidewall defining an opening;

a sliding member slidably mounted in the assembled portion, the sliding member partially exposing out of the opening, the sliding member including a main portion, one resisting portion, and one post, the resisting portion perpendicularly protruding from one end of the main portion, the post protruding from the resisting portion; and two elastic members disposed between the assembled portion and the sliding member providing a force against the sliding member and press the sliding member against the interior surface of the sidewall.

11. The slide-type button assembly as claimed in claim 10, wherein the assembled portion includes two resisting blocks, the resisting blocks slightly angled towards the sidewall, and each elastic member is disposed between the resisting portion of the sliding member and one resisting block.

12. The slide-type button assembly as claimed in claim 11, wherein each resisting block includes a limiting portion, the limiting portion and the sidewall defines a slot, the sliding member is slidably received in the slot.

13. The slide-type button assembly as claimed in claim 11, wherein the body member includes a bottom wall connected to the sidewall, the resisting blocks protrudes from the bottom wall adjacent to the opening.

14. The slide-type button assembly as claimed in claim 11, wherein the assembled portion further includes two stopping blocks, the stopping blocks perpendicularly protrudes from the interior surface of the sidewall, adjacent to the opening, the stopping blocks for abutting against the sliding member.

15. The slide-type button assembly as claimed in claim 10, further comprising a switch, wherein the switch is mounted to the body member, facing the opening, the sliding member slides to trigger the switch.

16. The slide-type button assembly as claimed in claim 15, wherein the switch is a double-gear switch corresponding to two functions, the switch includes a main body fastened to the body member, and a dialing post swinging relative to the main body and driven by the sliding member.

17. The slide-type button assembly as claimed in claim 16, wherein the sliding member includes two spaced-apart projections, the two projections formed on the main portion and define a latching slit therebetween, the slit receiving the dialing post therein.

18. The slide-type button assembly as claimed in claim 10, wherein the sliding member includes an operating portion, the operating portion forming a surface used to facilitate sliding the sliding member.

19. The slide-type button assembly as claimed in claim 11, wherein the post is slightly angled away from the opening, each elastic member coils around the post, with one end resisting the resisting portion, the other end resisting one resisting block.

* * * * *